US005588782A

United States Patent [19]

Haring

[11] Patent Number: 5,588,782

[45] Date of Patent: Dec. 31, 1996

[54] PORTABLE BOAT DOCK

[76] Inventor: William F. Haring, 8839 Holly La., Riverside, Calif. 92503

[21] Appl. No.: 385,453

[22] Filed: Feb. 8, 1995

[51] Int. Cl.[6] ..... B63C 1/00

[52] U.S. Cl. ..... 405/218; 14/71.1; 114/263; 405/221

[58] Field of Search ..... 405/1, 7, 118, 405/119, 120, 121, 122; 14/71.1, 72.5; 114/263, 264, 362

[56] References Cited

U.S. PATENT DOCUMENTS

| | | | |
|---|---|---|---|
| 3,492,825 | 2/1970 | Pearson | 405/219 |
| 4,287,625 | 9/1981 | Dawson | 114/362 |
| 4,398,849 | 8/1983 | Moran et al. | 405/221 |
| 4,653,769 | 3/1987 | Kenney et al. | 280/414.1 |
| 4,799,447 | 1/1989 | Hebert et al. | 114/362 |

*Primary Examiner*—Henry A. Bennett
*Assistant Examiner*—Pamela A. O'Connor
*Attorney, Agent, or Firm*—Boniard I. Brown

[57] ABSTRACT

The portable boat dock includes a first dock section, a second dock section and a hinge for pivotally attaching the first and second dock sections together. The first dock section has at least one hole for receiving a stake to secure the boat dock to the ground or other supporting surface. The second dock section has at least one hole for receiving a support member which rest on the supporting surface for supporting the second dock section. The first dock section has a first channel and the second dock section has a second channel. A reinforcing member is sized and adapted to be disposed within one of the channels and engagable with the other of the channels for alternating between pivoting movement and rigid support of the first and second dock sections. A detent device secures the support member to the second dock section and may be repositioned in various holes of the support member for adjustment of the support member for various depths of water. The boat dock may be collapsed into a storage container, having the components of the dock housed between the first and second dock sections.

22 Claims, 2 Drawing Sheets

PORTABLE BOAT DOCK

BACKGROUND OF THE INVENTION

The invention relates to docks and, more particularly, to a portable boat dock which may be folded together providing a storage container for the components of the boat dock.

To moor a boat in a location where a permanent dock is not available, a member of the crew may jump onto the shore before the boat collides with the ground or may disembark from the boat into the water to secure the boat to a permanent object on the shore. The other members of the crew must then jump to shore from the boat. These practices are inconvenient.

A portable boat dock is disclosed in U.S. Pat. No. 4,398,849 issued Aug. 16, 1983 to Moran and entitled "Portable Dock". The portable dock includes a plurality of dock sections, adjustable legs, and coupling units for securing together the dock sections and a dock section to the ground. However, the dock includes numerous parts to assemble and does not fold into a self-contained storage container for housing the parts of the dock.

Another boat dock disclosed in U.S. Pat. No. 4,287,625 issued Sep. 8, 1981 to Dawson and entitled "Portable Boat Dock" includes a deck structure which floats and a gang plank which may be folded over in a storage configuration. However, due to the size of the flotation devices, the dock may be bulky and difficult for one person to handle.

Therefore, what is needed is an apparatus for docking a boat which may be collapsed into a storage container for housing the components thereof, which is easily maneuverable, and which is sufficiently compact to fit conveniently in a boat or an automotive vehicle.

SUMMARY OF THE INVENTION

A dock includes a first dock section having a first end, a second end, and a first deck portion extending therebetween and a second dock section having a first end, a second end, and a second deck portion extending therebetween. The first end of the second dock section has at least one hole. A means for pivotally attaching the second end of the first dock section and the second end of the second dock section secures the dock sections together.

The dock includes a means for anchoring the first end of the first dock section to a supporting surface. At least one support member is removably attached to the second dock section, being sized and adapted to be received within the hole of the second dock section and extending therethrough. The support member has a first end, a second end, and the hole of the second dock section positioned between the first and second ends during use of the dock. The second end of the support member contacts the supporting surface for maintaining the dock in a selected position.

The dock also includes a first channel extending at least partially between the first and second ends of the first dock section, and a second channel extending at least partially between the first and second ends of the second dock section. A reinforcing member is slidably positioned within one of the first and second channel and engagable within the other of the first and second channels for substantially preventing hinged movement of the first and second dock sections. A detent device is attached to one of the first and second dock sections and engagable with the support member for retaining the support member in a selected position.

The dock may be folded into a storage configuration including means for retaining the support members, a fastener for securing together the first and second dock sections, and at least one handle for transporting the dock having the components housed therein. This storage configuration is so compact as to be easily positioned in a boat or automobile for convenient transport.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention described herein provides an apparatus for docking a boat which is portable and collapsible into a self-contained storage container.

Figure 1:
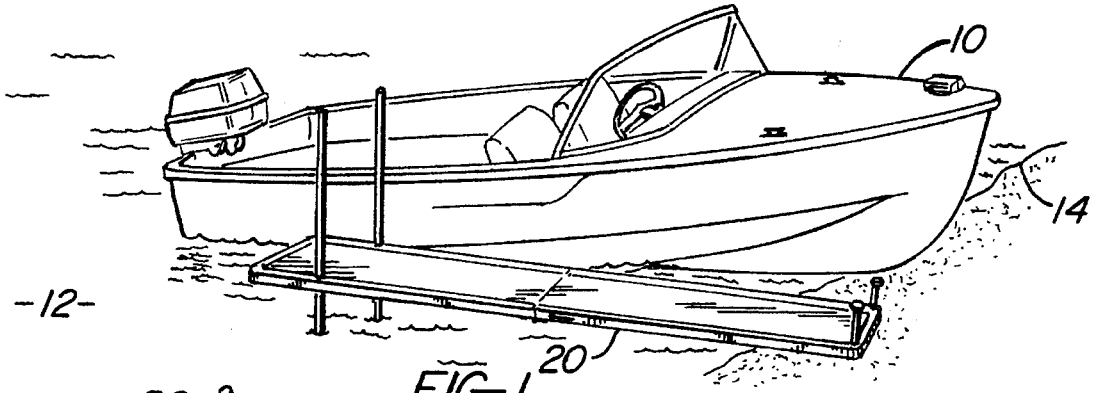
FIG. 1 is a schematic illustration of a boat positioned at a boat dock.
Figure 2:
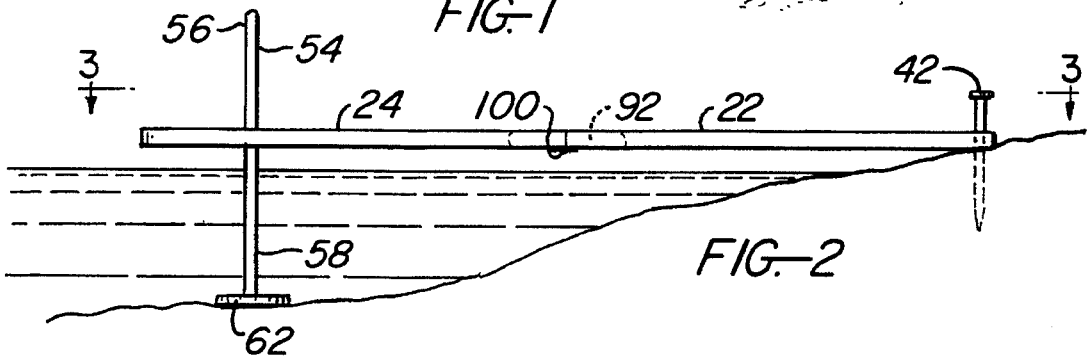
FIG. 2 is a side view of the boat dock.
Figure 3:
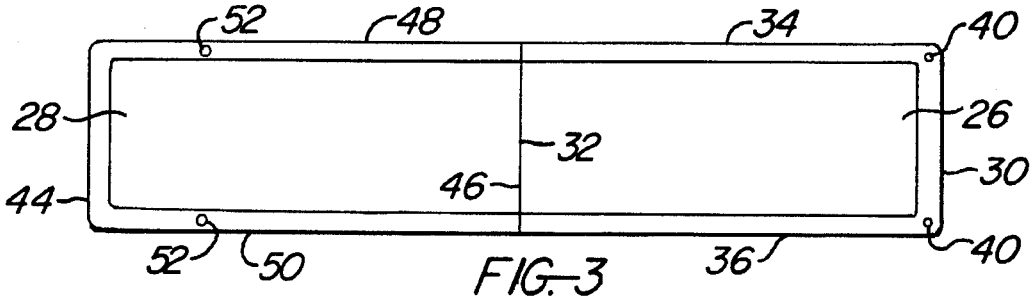
FIG. 3 is a view taken along line 3—3 of FIG. 2.

Referring to FIGS. 1–3, a boat 10 is positioned within the water 12 along the shore 14 and beside a portable boat dock 20. The boat dock 20 includes a first dock section 22 and a second dock section 24. The first and second dock sections 22 and 24 have a first and second deck portion 26 and 28, respectively, for providing a surface for a person to walk on during use of the boat dock 20.

The first dock section 22 has a first end 30, a second end 32, and a first side 34 and second side 36 extending therebetween. The first end 30 has at least one hole 40. A first channel 41 extends at least partially along at least one side 34 or 36 of the first dock section 22. Preferably, the first dock section 22 has two holes 40 and the first channels 41 extending on each side 34 and 36.

The boat dock 20 also includes a means for anchoring the first dock section 22 to the ground or other supporting surface, such as a stake 42 sized and adapted to be inserted through each hole 40 of the first dock section 22 and into the shore 14 or any supporting surface for securing the boat dock 20 to a permanent structure. The stake 42 has a tapered portion for insertion into the ground and an enlarged portion for receiving a force to drive the stake 42 into the ground.

The second dock section 24 has a first end 44, a second end 46, and a first side 48 and second side 50 extending therebetween. The first end 44 has at least one hole 52. A second channel 53 extends at least partially along at least one side 48 or 50 of the second dock section 24. Preferably, the second dock section 24 has two holes 52 and the second channels 53 extends on each side 48 and 50.

Referring to FIGS. 1–3 and 6, the boat dock 20 includes a support member 54 attached to the second dock section 24. The support member 54 is sized and adapted to be inserted in each hole 52 of the second dock section 24 for supporting the boat dock 20 above the water 12. The support member 54 has a first end 56 and a second end 58. The second end 58 of the support member 54 or leg is at least partially submerged in the water 12 and rests on the ground beneath the water 12. The first end 56 extends through the second dock section 24 above the water 12. Positioned between the first end 56 and second end 58 of the support member 54 are a plurality of holes 60 for enabling adjustment of the position of the attachment of the support member 54 to the second dock section 24 for adjustment of the boat dock 20 with respect to the water 12 for varying depths of water.

Figure 9:
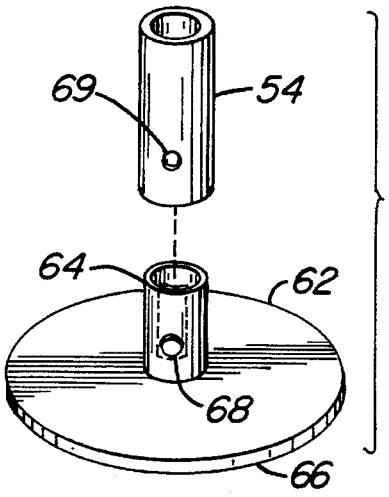
FIG. 9 is a schematic illustration of the support member and a base.

Referring to FIGS. 2 and 9, the second end 58 of the support member 54 may be integrally formed with or attached to a base 62. The base 62 has a first portion 64 engagable with the second end 58 and an enlarged portion 66 for resting on the ground beneath the water 12. The first portion 64 has a protuberance 68 engagable with an opening 69 in the support member 54 for attachment of the base 62 to the support member 54. The enlarged portion 66 provides additional support to boat dock 20.

Figure 4:
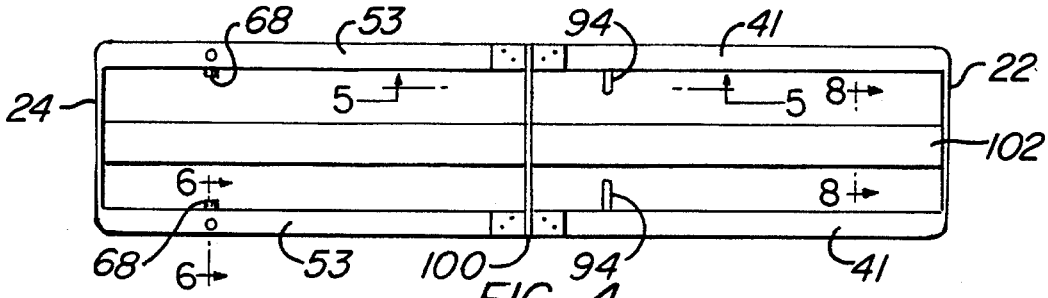
FIG. 4 is a view of an underside of the boat dock.
Figure 6:
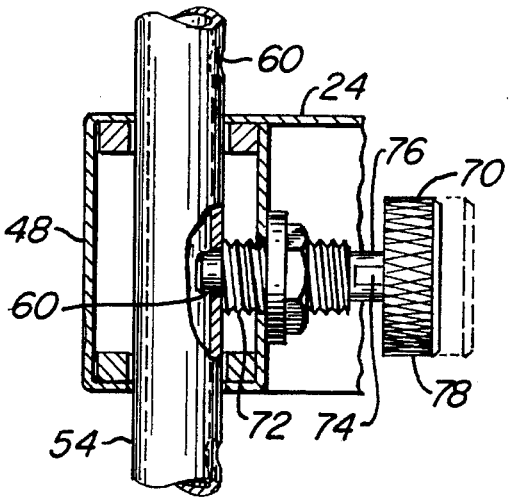
FIG. 6 is a view taken along line 6—6 of FIG. 4 of a detent device.

Referring to FIGS. 4 and 6, the support member 54 is attached to the second dock section 24 by a detent device. The positioning of the detent device in various holes 60 retains the support member 54 in selected position to adjust for water depth. Each hole 60 may be positioned adjacent to a recessed portion in the support member 54 for engagement with the detent device 70.

An example of a detent device is detent device 70 illustrated in FIG. 6, including a spring mechanism 72, a locking mechanism 74, a pin 76, a handle 78, and means for attaching 80 the detent device 70 to the dock section 24. The detent device 70 is attached to a side, such as side 48, of the second dock section 24 and extends inwardly from the first side 48 towards the second side 50. The means for attaching 80 may be a nut and washer engagable with a threaded portion of the pin 76. Alternatively, the means for attaching 80 may be a lock washer, threaded connection, or the like.

The spring mechanism 72 maintains tension between the detent means 70 and the support member 54. The pin 76 is sized and adapted to be positioned within the hole 60 of the support member 54. The locking mechanism 74, such as a keyway engagable with a key, threaded connection, or the like retains the pin 76 in the selected hole 60 of the support member 54. The handle 78 has a knurled end for enabling a person to grasp and manipulate the handle 78 without losing hold of the handle 78.

To operate the detent device 70, the handle 78 is pulled against the tension of the spring mechanism 72. The pin 76 is aligned with and positioned adjacent to the desired hole 60. The handle 78 is released allowing the pin 76 to extend through the hole 60, and rotated, to engage the locking mechanism 74. To reposition the detent device 66, the handle 78 is rotated and pulled against the pressure, drawing the pin 76 from the hole 60.

Figure 6A:
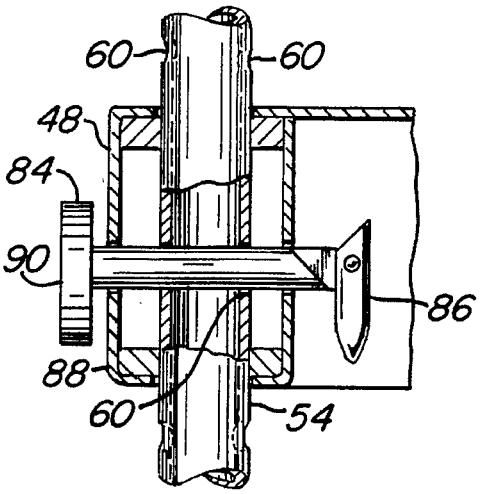
FIG. 6A is a view taken along line 6—6 of FIG. 4 of an alternative embodiment of the detent device.

Referring to FIGS. 4, 6 and 6A, as an alternative to the detent device 70 of FIG. 6, a detent device 84 as illustrated in FIG. 6A includes a clip 86 and a pin 88, and a handle 90. The pin 88 is sized and adapted to be inserted through hole 60 of the support member 54 and to be engagable with the clip 86 for providing a locking mechanism to retain the support member 54 in a fixed position with respect to the second dock section 24. The handle 90 is positioned on one side of the side 48 of the second dock section 24 and the clip 86 is positioned on the other side. To operate the detent device 84, the pin 88 is aligned with one of the hole 60 of the support member 54 and inserted through the hole 60. The clip 86 is engaged with the pin 88. To reposition the detent device 84, the clip 86 is rotated and released from the pin 88, allowing the handle 90 to be grasped and pulled, drawing the pin 88 through the hole 60.

Figure 5:
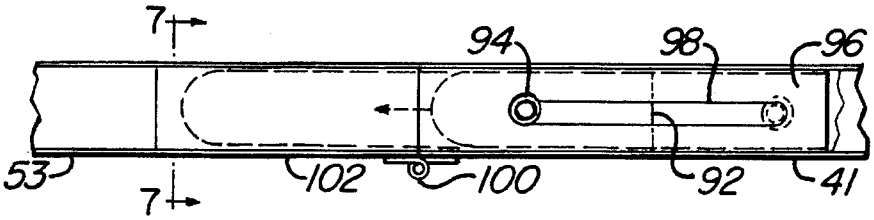
FIG. 5 is a view taken along line 5—5 of FIG. 4 of a first channel, a second channel, and a reinforcing member.
Figure 7:
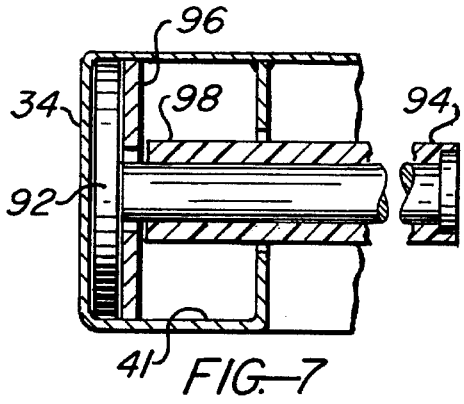
FIG. 7 is a view taken along line 7—7 of FIG. 5 of the reinforcing member and a guide member.

Referring to FIGS. 4, 5 and 7, the boat dock 20 includes a reinforcing member 92 sized and adapted to be positioned within the channels 41 and 53 of the first and second dock sections 22 and 24 for providing a rigid support between the first and second dock sections 22 and 24. The reinforcing member 92 is positioned within one of the channels 41 or 53 and is slidable into the other of the channels 41 or 53 so that a portion of the reinforcing member 92 is positioned within the channel 41 and a portion of the reinforcing member 92 is positioned within the channel 53. Preferably, two reinforcing members 92 are used, having one reinforcing member 92 positioned within the channels 41 and 53 of the first sides 34 and 48 and a second reinforcing member 92 positioned within the channels 41 and 53 of the second sides 36 and 50.

The reinforcing member 92 is attached to a handle 94 which may be a pin, bar, or the like for enabling a person to grasp the handle 94 to move the reinforcing member 92 through the channels 41 and 53. As illustrated in FIG. 4, the handles 94 extend inwardly from and are positioned between the sides 34 and 36.

Preferably and as illustrated in FIG. 7, a guide member 96 having a slot 98 is attached to at least one of the dock sections 22 and 24 for restricting the movement of the reinforcing member 92. The reinforcing member 92 is positioned between the guide member 96 and the first or second sides 34, 36, 48, or 50 of the dock section 22 or 24. The handle 94 of the reinforcing member 92 extends through the slot 98 and is slidable within the slot 98. The slot 98 is sized and positioned to provide a stop for the handle 94 at a first position which disposes the reinforcing member 92 in one of the channels 41 or 53 for enabling the boat dock 20 to be folded. The slot 98 also provides a stop for the handle 94 at a second position which disposes the reinforcing member 92 in both of the channels 41 and 53 for providing a rigid support for enabling a person to walk on the boat dock 20.

Referring to FIGS. 2, 4 and 5, the boat dock 20 further includes a means for attaching or a hinge 100 attached to the first and second dock sections 22 and 24 for enabling pivotal movement of the first and second dock sections. Preferably, the hinge 100 is attached to an underside 102 of the dock sections 22 and 24 for enabling the dock sections to be folded with the first and second deck portions 22 and 24 exposed and the undersides 102 of the dock sections 22 and 24 confronting each other.

Figure 8:
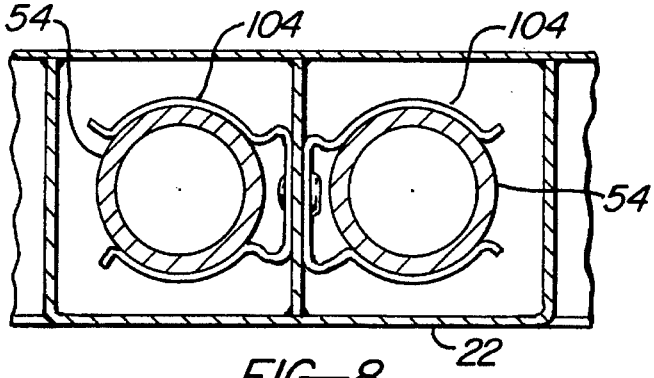
FIG. 8 is a view taken along line 8—8 of FIG. 4 of two support members positioned in a storage configuration.
Figure 10:
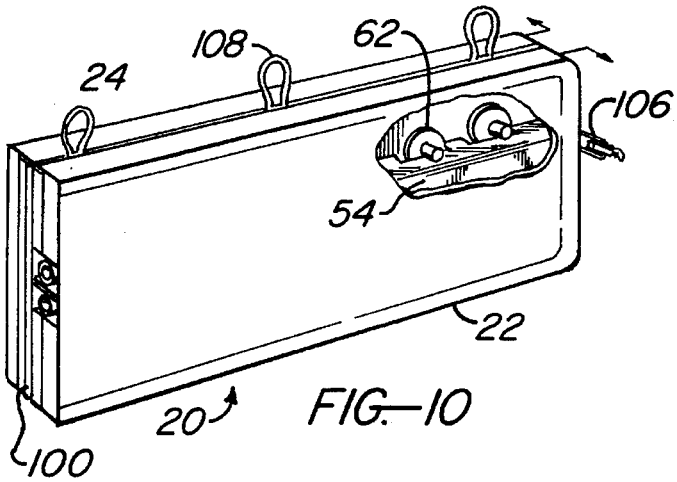
FIG. 10 is a schematic illustration of the boat dock in a self-contained storage configuration.

Referring to FIGS. 4, 8 and 10, at least one of the first and second deck portions 26 and 28 has a means for retaining or a clasp 104 for engaging and retaining the support members 54 during storage of the boat dock 20. The clasps 104 are positioned so that the support members 54 are housed between the first and second deck portions 26 and 28 in the storage configuration.

A fastener 106 is attached to the first ends 30 and 44 of the first and second dock sections 22 and 24 for securing together the first and second dock sections in the storage configuration.

At least one handle 108 is attached to boat dock 20 for enabling a person to grasp the handle 108 for carrying and transporting the boat dock 20. Preferably, the handle 108 is attached to one of the sides 34, 36, 48, or 50 of the first or second dock sections 22 or 24.

As an example, the components of the boat dock 20 may be manufactured from aluminum, plastic foam, or the like. The boat dock 20 in a position for docking a boat may be approximately 8 to 10 feet long and weigh approximately 60 pounds.

To utilize the boat dock 20, the fastener 106 is opened, allowing the first and second dock sections 22 and 24 to be unfolded. The handle 94 of each of the reinforcing members 92 is moved, advancing the reinforcing member 92 through the channel 41 or 53 into the other of the channels 42 and 53. The detent device 70 or 84 is aligned with one of the holes 60 and attached to the support member 54 at a desired location. The first and second dock sections 22 and 24 are positioned above the water 12 having the support member 54 resting on the ground beneath the water 12. The stakes 42 are inserted through the holes 40 and driven into the ground or shore 14. The position of the detent device 70 or 84 may be adjusted to accommodate various depths of water. A person may conveniently walk from the shore 14 onto the first and second deck portions 26 and 28 for an easy and dry means of access to and from the boat 10.

To collapse the boat dock 20 into the storage configuration, the stakes 42 are removed from the ground and the boat dock 20 is lifted out of the water 12. The detent device 70 or 84 is unlocked and the support member 54 is detached from the second dock section 24. The base 62 is detached from the support member 54 and positioned on the underside 102 of one of the first and second dock sections 22 or 24. The support members 54 are removably attached to the clasps 104 for retaining the support members 54 between the first and second dock sections 22 and 24 in the storage configuration. The stakes 42 are placed between the first and second dock sections 22 and 24. The reinforcing member 92 is slid into one of the channels 41 or 53, allowing the first and second dock sections 22 and 24 to be folded together. The fastener 106 is closed securing together the components of the boat dock 20.

Alternative uses of the boat dock 20 may be as a ramp, such as for wheelchairs or for loading and unloading a truck, or the like. Also, by providing support members 54 at each of the first ends 30 and 44, the boat dock 20 can be used as a table.

An advantage of the boat dock 20 is that the boat dock 20 is portable and may be collapsed into a storage configuration facilitating easy storage and transportability within the boat 10. The boat dock 20 is transformable into a self-contained storage container having an area for storing the components of the boat dock 20. Also, the handles 108 may be grasped by a person for easily carrying and transporting the boat dock 20 from one location to another.

Therefore, the invention provides an apparatus for docking a boat which is collapsible into a storage container for housing the components of the boat dock, which container is compact and easily storable and portable in a boat or automotive vehicle.

I claim:

1. A dock comprising:

a first dock section having first and second ends and a deck portion extending therebetween;

means for retaining said first end of said first dock section on a supporting surface;

a second dock section having first and second ends and a deck portion extending therebetween;

means hingedly attaching the second end of said first dock section to said second end of said second dock section;

reinforcing means carried by one of said first and second dock sections and extensible from said one dock section to engage the other of said dock sections substantial to prevent hinged relative movement of said first and second dock sections; and at least one support member adapted to engage said second dock section to extend downwardly therefrom to engage an underwater surface to maintain said dock in a selected position.

2. The dock according to claim 1, further comprising:

a first channel extending at least partially between said first and second ends of said first dock section;

a second channel extending at least partially between said first and second ends of said second dock section; and wherein said reinforcing member is slidably positioned within one of said first and second channels and engagable with the other of said first and second channels for substantially preventing hinged movement between said first and second dock sections.

3. The dock according to claim 2, further comprising a handle attached to said reinforcing member for movement of said reinforcing member through said first and second channels.

4. The dock according to claim 3, further comprising guide member attached to each channel and having a slot sized and adapted to receive said handle of said reinforcing member for restricting movement of said reinforcing member.

5. The dock according to claim 1, further comprising a detent device attached to at least one of said first and second dock sections and engagable with said support member for retaining said support member in a selected position.

6. The dock according to claim 5, wherein:

said support member has at least one hold therein, and said detent device includes a pin sized and adapted to be positioned within said hole of said support member for engagement of said detent device and said support member, and further including a locking mechanism attached to said pin for securing together said detent device and said support member.

7. The dock according to claim 6, further comprising a spring mechanism attached to said pin for forcing said pin through said at least one hole of said support member.

8. The dock according to claim 5, wherein said support member has a plurality of spaced apart holes therein for engagement with said detent device for varying the position of said second dock section with respect to said support member for compensating for various depths of water.

9. A dock according to claim 1, wherein:

said second dock section has at least one hole therein; and said at least one support member is adapted to extend through said at least one opening to engage said underwater surface.

10. A dock, comprising:

a first dock section having a first end, a second end, a first side, a second side, and a first deck portion extending therebetween;

a first channel extending at least partially along at least one of said first and second sides of said first dock section;

a second dock section having a first end, a second end, a first side, a second side, and a second deck portion extending therebetween;

a second channel extending at least partially along at least one of said first and second sides of said second dock section;

means for pivotally attaching said second end of said first dock section and said second end of said second dock section together;

a reinforcing member slidably positioned within one of said first and second channels and engagable with the other of said first and second channels for providing a rigid support to substantially prevent pivotal movement of said first and second dock sections;

means for anchoring said first end of said first dock section to a supporting surface; and at least one support member attached to said first end of said second dock section and contacting said supporting surface for supporting said dock.

11. The dock according to claim 10, further comprising a detent device attached to said second dock section and engagable with said support member for retaining said support member in a selected position.

12. The dock according to claim 11, wherein:

said support member has at least one hole, and said detent device includes a pin sized and adapted to be positioned within said at least one hole of said support member for engagement of said detent device and said support member, and further including a locking mechanism attached to said pin for securing together said detent device and said support member.

13. The dock according to claim 12, further comprising a spring mechanism attached to said pin for forcing said pin through said hole of said support member.

14. The dock according to claim 10, further comprising a handle attached to said reinforcing member for movement of said reinforcing member through said first and second channels.

15. The dock according to claim 14, further comprising a guide member attached to each channel and having a slot sized and adapted to receive said handle of said reinforcing member for restricting movement of said reinforcing member.

16. A dock, comprising:

a first dock section having a first end, a second end, and a first deck portion extending therebetween;

means for anchoring said first end of said first dock section to a supporting surface;

a second dock section having a first end, a second end, and a second deck portion extending therebetween, said first end having support member engagement means thereon;

a hinge attached to said second end of said first dock section and to said second end of said second dock section;

a fastener attached to said first and second dock sections for securing together said first and second dock sections in a storage configuration of said dock;

at least one support member attached to said engagement means on said second dock section and contacting said supporting surface of upholding said dock;

means for retaining each support member between said first and second dock sections in the storage configuration; and at least one handle attached to at least one of said first and second dock sections for transporting said dock.

17. The dock according to claim 16, further comprising:

a first channel extending at least partially between said first and second ends of said first dock section;

a second channel extending at least partially between said first and second ends of said second dock section; and a reinforcing member slidably positioned within one of said first and second channels and engagable with the other of said first and second channel for substantially preventing hinged movement of said first and second dock sections.

18. The dock according to claim 17, further comprising:

a handle attached to said reinforcing member for movement of said reinforcing member through said first and second channels; and a guide member attached to each channel and having a slot sized and adapted to receive said handle of said reinforcing member for restricting movement of said reinforcing member.

19. The dock according to claim 16, wherein:

said support member has at least one hole, and further comprising:

a detent device, attached to said support member and to said second dock section, including a pin sized and adapted to be positioned within said hole of said support member for engagement of said detent device and said support member, and further including a locking mechanism attached to said pin for securing together said detent device and said support member.

20. The dock according to claim 16, wherein:

said first end of said first dock section has at least one hole; and said means for anchoring is a stake sized and adapted to be disposed within each hole of said first end of said first dock section for securing said dock to said supporting surface.

21. The dock according to claim 16, wherein said first and second dock sections have an underside; and said hinge is attached to said underside thereof for enabling said first and second dock sections to be folded together with said underside of said first dock section confronting said underside of said second dock section.

22. The dock according to claim 16, wherein:

said support member engagement means on said first end of said second dock section comprises at least one hole; and said at least one support member is sized and adapted to be received within said at least one hole of said second dock section.

* * * * *